US008593235B2

(12) United States Patent
Chong

(10) Patent No.: US 8,593,235 B2
(45) Date of Patent: Nov. 26, 2013

(54) CAVITY FILTER THERMAL DISSIPATION

(75) Inventor: Yin-Shing Chong, Middletown, CT (US)

(73) Assignee: Alcatel Lucent, Paris (FR)

( * ) Notice: Subject to any disclaimer, the term of this patent is extended or adjusted under 35 U.S.C. 154(b) by 334 days.

(21) Appl. No.: 13/049,564

(22) Filed: Mar. 16, 2011

(65) Prior Publication Data

US 2012/0235770 A1 Sep. 20, 2012

(51) Int. Cl.
*H01P 1/205* (2006.01)
*H01P 7/04* (2006.01)
*H01P 1/30* (2006.01)

(52) U.S. Cl.
USPC ..... 333/203; 333/222; 333/234

(58) Field of Classification Search
USPC ..... 333/22 R, 219, 226, 227, 229, 234, 235, 333/203, 222
See application file for complete search history.

(56) References Cited

U.S. PATENT DOCUMENTS

| | | | | |
|---|---|---|---|---|
| 3,935,552 | A | 1/1976 | Hutcheon | |
| 7,193,489 | B2 * | 3/2007 | Kornowski et al. | 333/219.1 |
| 7,607,470 | B2 * | 10/2009 | Glezer et al. | 165/121 |
| 2006/0119454 | A1 | 6/2006 | Kornowski et al. | |
| 2007/0057747 | A1 | 3/2007 | Kubo et al. | |
| 2007/0159275 | A1 * | 7/2007 | Craig et al. | 333/202 |
| 2009/0058566 | A1 * | 3/2009 | Jones et al. | 333/227 |

FOREIGN PATENT DOCUMENTS

FR 2315176 A1 1/1977

OTHER PUBLICATIONS

International Search Report for PCT/US2012/026765 dated May 25, 2012.

* cited by examiner

*Primary Examiner* — Benny Lee
*Assistant Examiner* — Rakesh Patel
(74) *Attorney, Agent, or Firm* — Kramer & Amado PC

(57) ABSTRACT

A cavity filter has a resonator. The resonator is engaged by a rod having a mounting portion and a thermal dissipation portion. The mounting portion of the rod extends through the floor of the cavity filter to engage an internal surface of the resonator. The thermal dissipation portion dissipates heat from the resonator to the outside of the cavity filter.

18 Claims, 8 Drawing Sheets

CAVITY FILTER THERMAL DISSIPATION

TECHNICAL FIELD

Various exemplary embodiments disclosed herein relate generally to cavity filters, for example microwave and radio frequency cavity filters.

BACKGROUND

Wireless communication systems often require devices to select signals within predetermined frequency bands. When these devices are implemented as bandpass filters, users can select a desired range of frequencies, known as a passband, and discard signals from frequency ranges that are either higher or lower than the desired range. The selectivity of a filter is measured by its "Q factor." Higher Q filters have a narrower passband, and in some instances are more effective at discarding frequencies outside the passband, as compared to a lower Q filter.

Cavity filters are devices frequently used to implement bandpass filters. A cavity filter has a resonant frequency that is determined, in part, by the geometry of a cavity.

SUMMARY

A brief summary of various exemplary embodiments is presented. Some simplifications and omissions may be made in the following summary, which is intended to highlight and introduce some aspects of the various exemplary embodiments, but not to limit the scope of the invention. Detailed descriptions of a preferred exemplary embodiment adequate to allow those of ordinary skill in the art to make and use the inventive concepts will follow in later sections.

Various exemplary embodiments relate to a cavity filter having a cavity formed by a floor, at least one wall, and a top, comprising: a resonator within the cavity having an interior surface and an exterior surface; and a rod having a mounting portion and a thermal dissipation portion; wherein the mounting portion of the rod extends through the floor of the cavity to engage the interior surface of the resonator and the thermal dissipation portion of the rod extends outside the cavity.

In some embodiments, the rod further comprises a clamping surface between the mounting portion and the thermal dissipation portion, the clamping surface engaging a side of the floor outside the cavity. In some embodiments, the resonator further comprises a lip extending from a lower surface of the resonator, the lip engaging a side of the floor inside the cavity. In some embodiments, the mounting portion further comprises an exterior surface having threads and the interior surface of the resonator further comprises threads. In some embodiments, the resonator is secured against the floor of the cavity by a force exerted by the rod. In some embodiments, the resonator is made of 64FeNi and the rod is made of at least one of aluminum, copper, gold, and silver. In some embodiments, the thermal dissipation portion comprises a plurality of disks radially extending from a central shaft, wherein the central shaft extends axially from the mounting portion.

Various exemplary embodiments further relate to an apparatus for mounting a resonator within a cavity filter having a cavity formed by a floor, at least one wall, and a top, comprising: a thermal dissipation portion; and a mounting portion extending through the floor of the cavity; wherein the mounting portion engages an interior surface of the resonator and the thermal dissipation portion extends outside the cavity.

In some embodiments, the apparatus further comprises: a clamping surface between the mounting portion and the thermal dissipation portion, the clamping surface engaging a side of the floor outside the cavity. In some embodiments, the resonator further comprises a lip extending from a lower surface of the resonator, the lip engaging a side of the floor inside the cavity. In some embodiments, the mounting portion further comprises an exterior surface having threads and the interior surface of the resonator further comprises threads. In some embodiments, the resonator is secured against the floor of the cavity by a force exerted by the clamping surface and a force exerted by the lip. In some embodiments, the apparatus is made of at least one of aluminum, copper, gold, and silver. In some embodiments, the thermal dissipation portion comprises a plurality of disks radially extending from a central shaft, wherein the central shaft extends axially from the mounting portion.

Various exemplary embodiments further relate to a method for dissipating heat from a resonator within a cavity filter, the cavity filter having a cavity formed by a floor, at least one wall, and a top, the method comprising: extending a mounting portion of a rod through the floor of the cavity filter; engaging an interior surface of the resonator with the mounting portion; and dissipating heat through a thermal dissipation portion of the rod outside the cavity.

In some embodiments, the rod further comprises a clamping surface between the mounting portion and the thermal dissipation portion, the clamping surface engaging a side of the floor outside the cavity. In some embodiments, the resonator further comprises a lip extending from a lower surface of the resonator, the lip engaging a side of the floor inside the cavity. In some embodiments, the mounting portion further comprises an exterior surface having threads and the interior surface of the resonator further comprises threads. In some embodiments, the method further comprising: securing the resonator against the floor of the cavity by a force exerted by the rod.

BRIEF DESCRIPTION OF THE DRAWINGS

Some embodiments of apparatus and/or methods in accordance with embodiments of the present invention are now described, by way of example only, and with reference to the accompanying drawings, in which.

DETAILED DESCRIPTION

Figure 1:
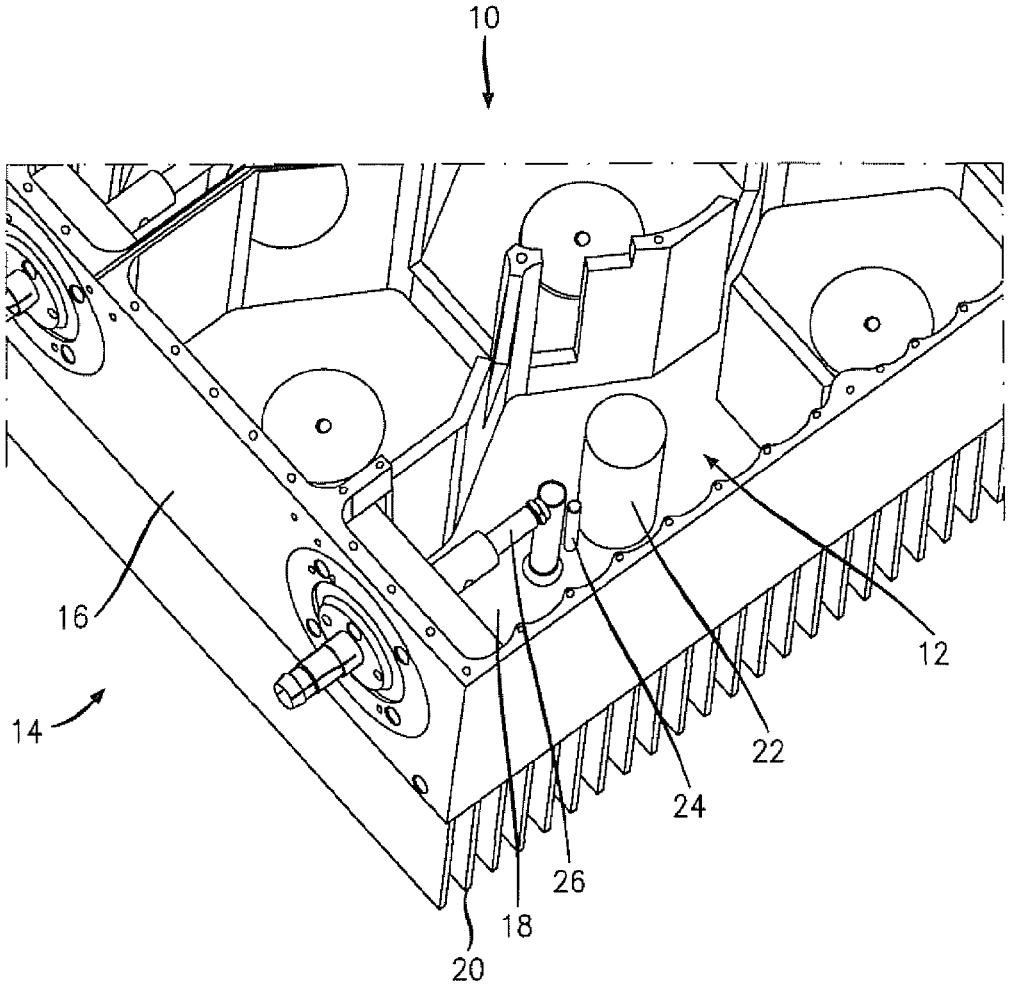
FIG. 1 is a perspective view of an exemplary cavity filter.

Referring now to the drawings, in which like numerals refer to like components, there are disclosed broad aspects of various exemplary embodiments.

FIG. 1 illustrates a cavity filter 10. The cavity filter 10 includes a cavity 12 formed within a housing 14. The housing 14 comprises a wall 16, a floor 18, and a top (not shown). A plurality of floor fins 20 extend outside the floor 18 of the housing 14, away from the cavity 12. A resonator 22, tuning post 24, and tap 26 are contained within the cavity 12, adjacent the floor 18. The tap 26 further extends through a portion of the wall 16.

Figure 2:
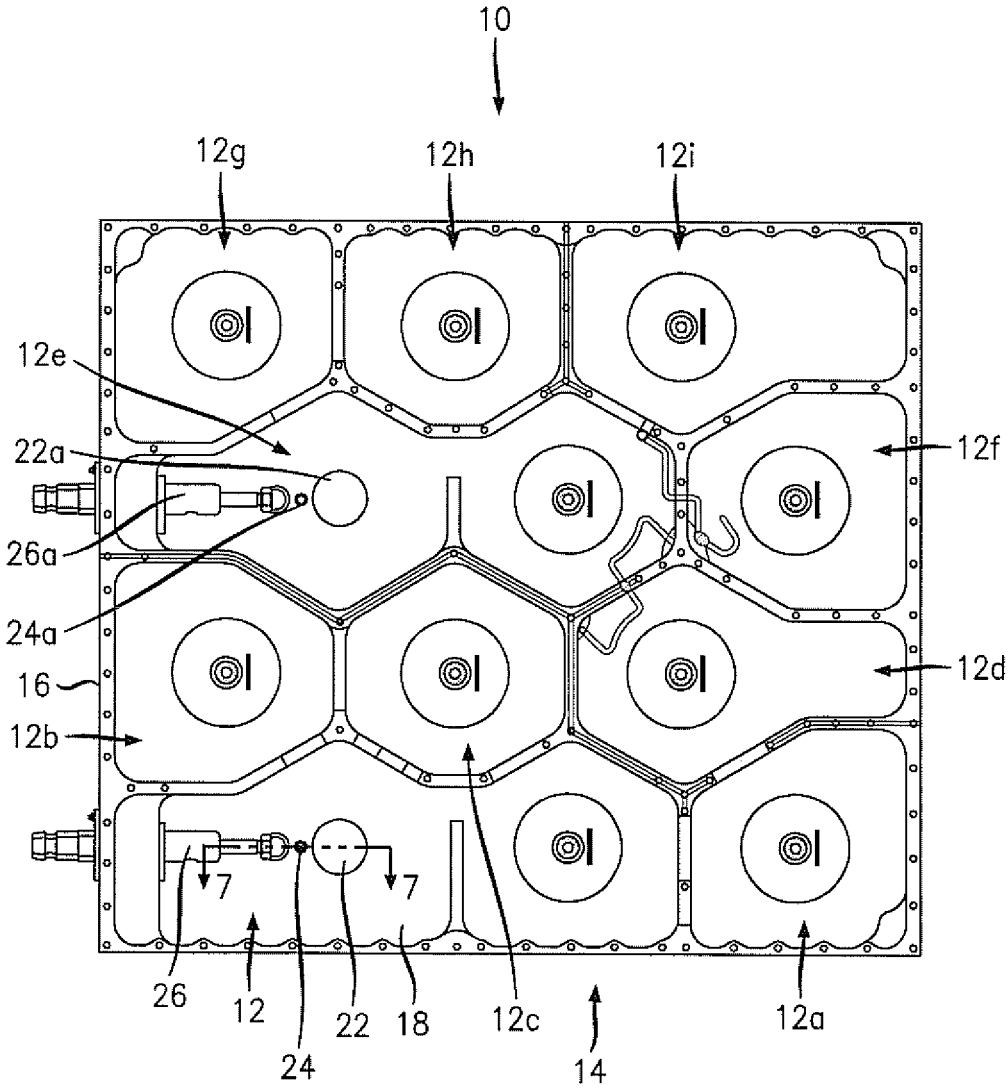
FIG. 2 is a top view of the cavity filter of FIG. 1.

As shown in FIG. 2, the cavity filter 10 may include multiple cavities 12, 12*a*, 12*b*, 12*c*, 12*d*, 12*e*, 12*f*, 12*g*, 12*h*, and 12*i* formed within the housing 14. The cavities 12-12*i* are formed by the wall 16, floor 18, and top (not shown). A second tap 26*a*, second tuning post 24*a*, and second resonator 22*a* may be included within one or more of the cavities 12-12*i*. The number of cavities, taps, resonators, and tuning posts used in the cavity filter 10 may vary according to implementation. The specific geometry of the cavities 12-12*i* may also vary according to implementation.

Figure 3:
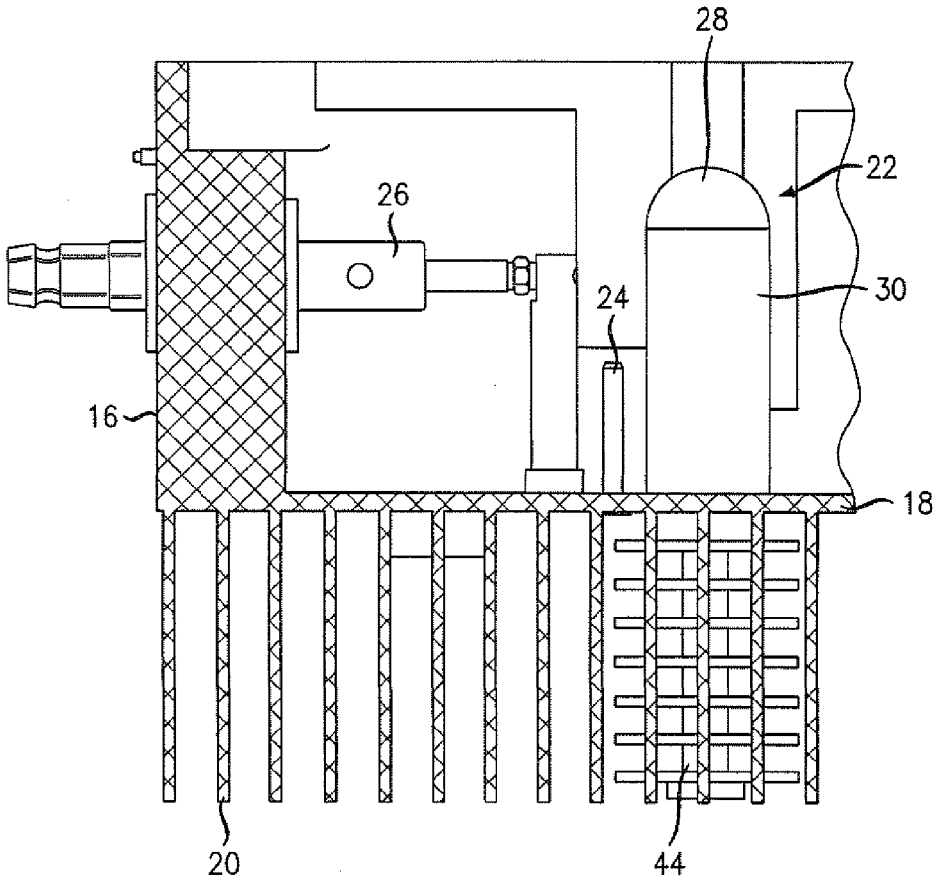
FIG. 3 is a side view of the cavity filter of FIG. 1.

FIG. 3 illustrates a side view of the cavity filter 10. The wall 16, floor 18, and floor fins 20 may be formed from a single material, such as, for example aluminum. The tap 26 is adjacent the floor 18, and extends through a portion of the wall 16. The tuning post 24 extends through the floor 18. The resonator 22 comprises an upper exterior surface 28 and a central exterior surface 30. A thermal dissipation portion 44 extends from the floor 18 below the resonator 22.

Figure 4:
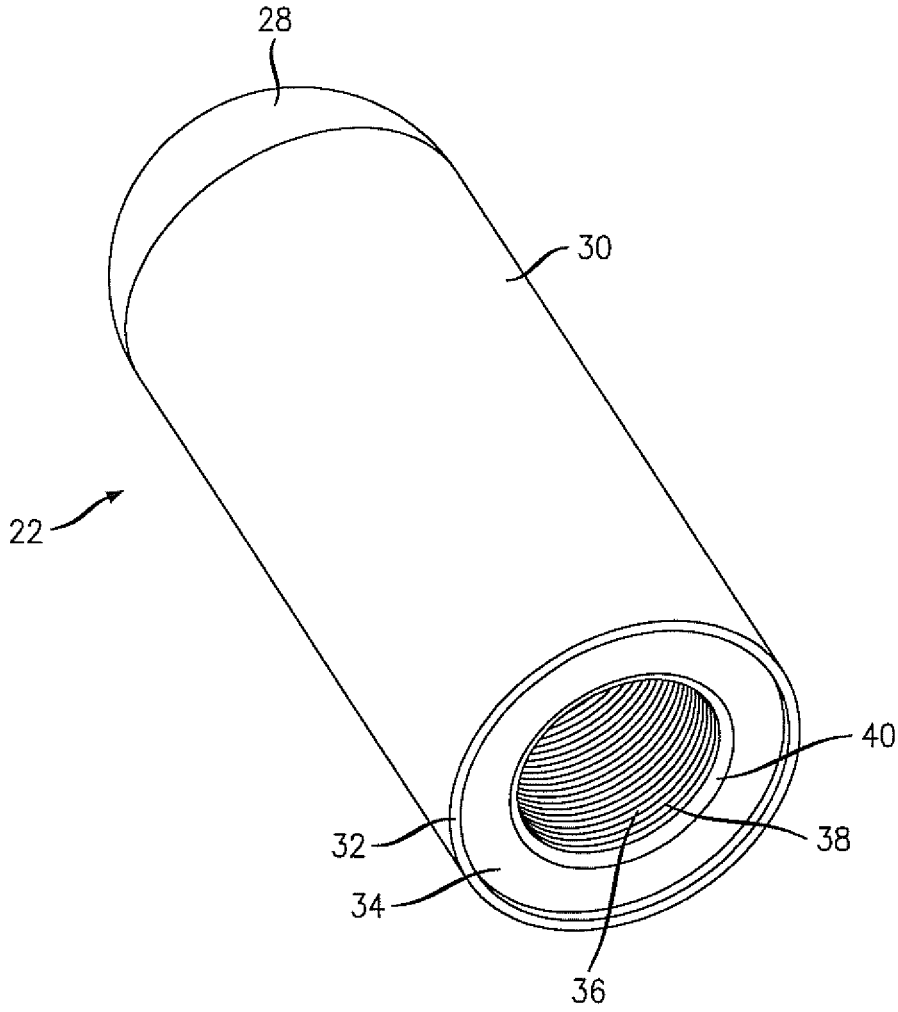
FIG. 4 illustrates an exemplary embodiment of a resonator.

FIG. 4 illustrates the resonator 22. In the present embodiment, the upper exterior surface 28 has a domed shape, and the central exterior surface 30 is cylindrical. The exterior resonator surfaces 28,30 may be formed into other shapes, including, but not limited to rectangular and square. A lip 32 extends from the central exterior surface 30 beyond a bottom surface 34 of the resonator 22. A central interior surface 36 includes interior threads 38. A transition surface 40 extends between the bottom surface 34 and the central interior surface 36.

Figure 5:
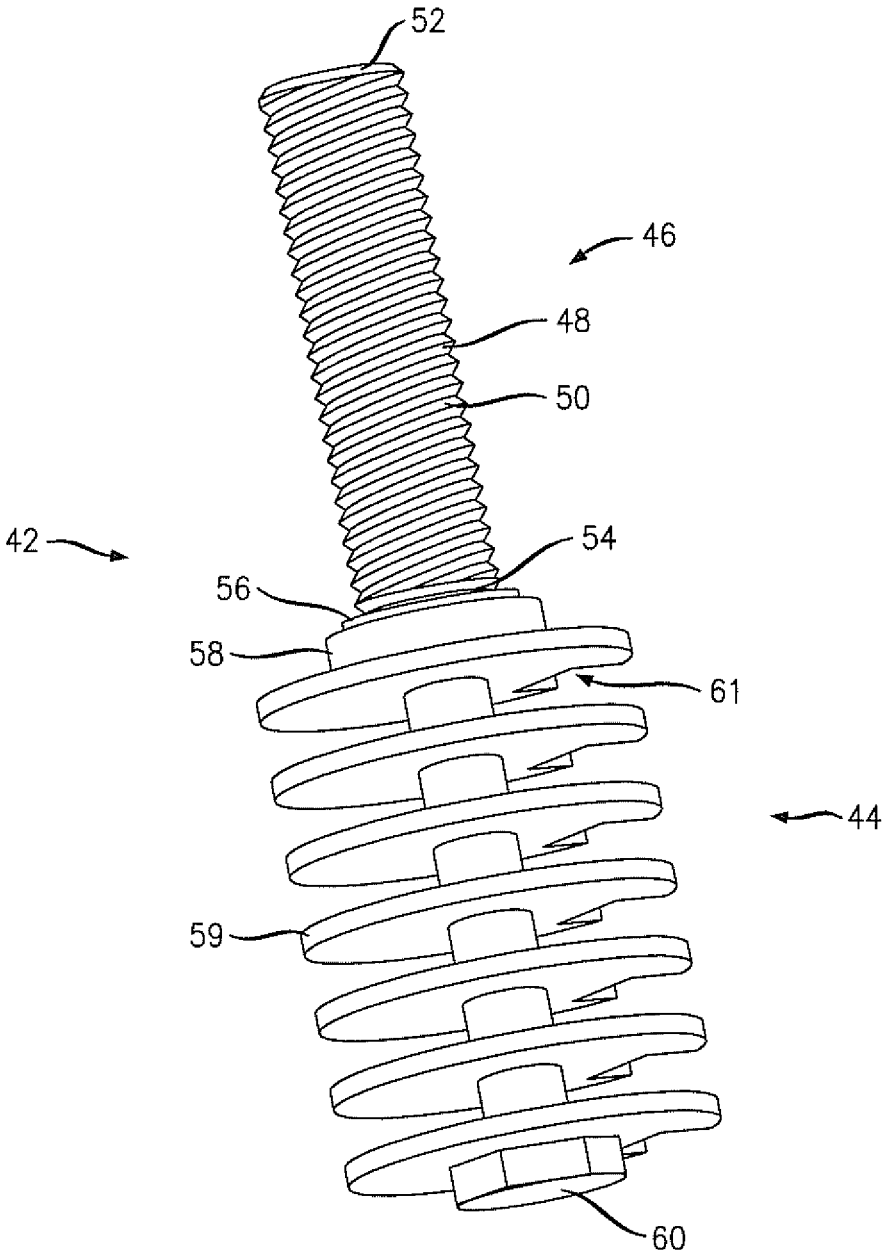
FIG. 5 illustrates an exemplary embodiment of a rod.

FIG. 5 illustrates a rod 42. The rod 42 includes the thermal dissipation portion 44 shown in FIG. 3 and a mounting portion 46. The mounting portion 46 includes an exterior mounting surface 48 having exterior threads 50. Exterior threads 50 extend between an upper tapered surface 52 and a lower tapered surface 54. A sealing ring 56 and a clamping ring 58 are positioned between the mounting portion 46 and the thermal dissipation portion 44. An exemplary embodiment of the thermal dissipation portion 44 includes a plurality of radially extending circular disks 59. The circular disks 59 may include a cutout portion 61. The cutout portion 61 provides space for assembly, maintenance, and/or other features of the cavity filter 10. A tool-engageable feature 60 or other engageable feature extends below the thermal dissipation portion 44.

Figure 6:
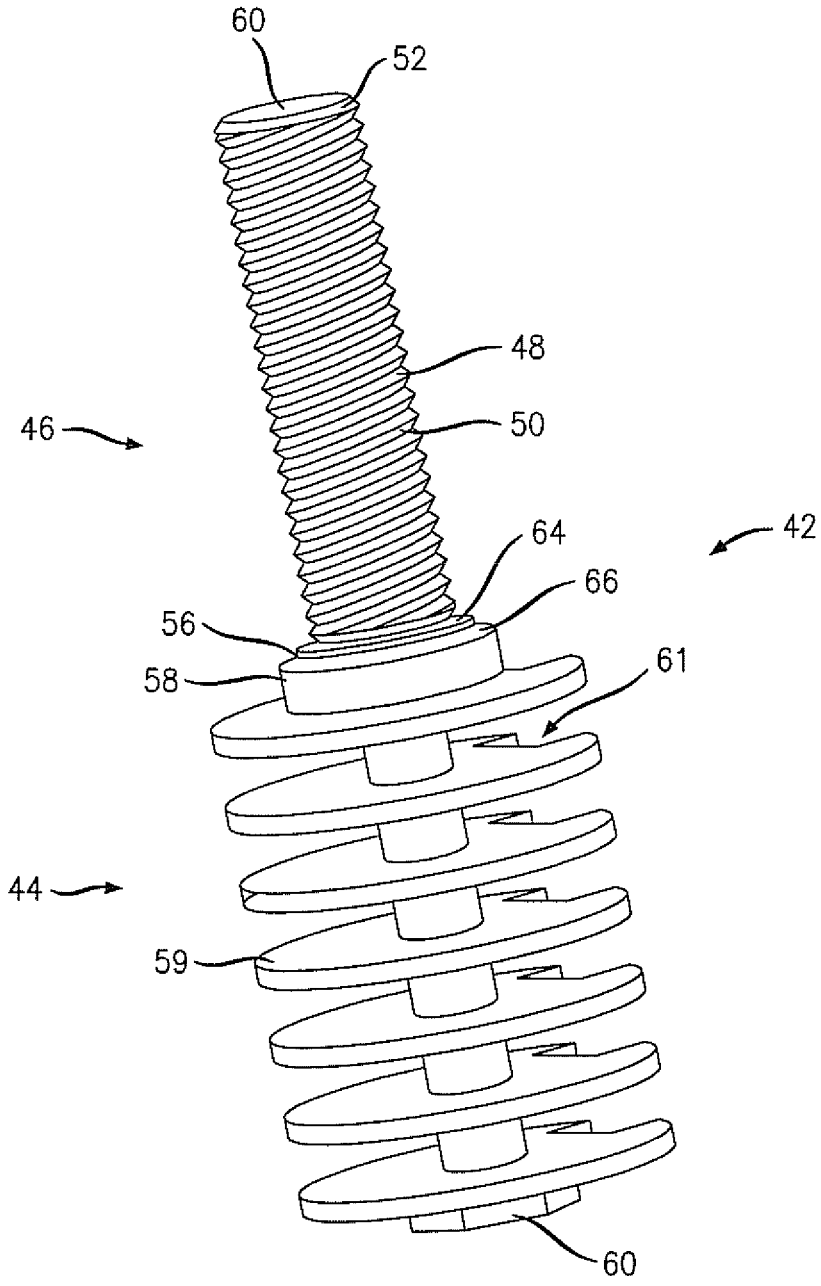
FIG. 6 is an alternate view of the rod of FIG. 5.

FIG. 6 illustrates an alternate view of the rod 42. The mounting portion 46 further includes a top surface 62. The sealing ring 56 includes an upper seal surface 64. The clamping ring 58 includes a clamping surface 66.

Figure 7:
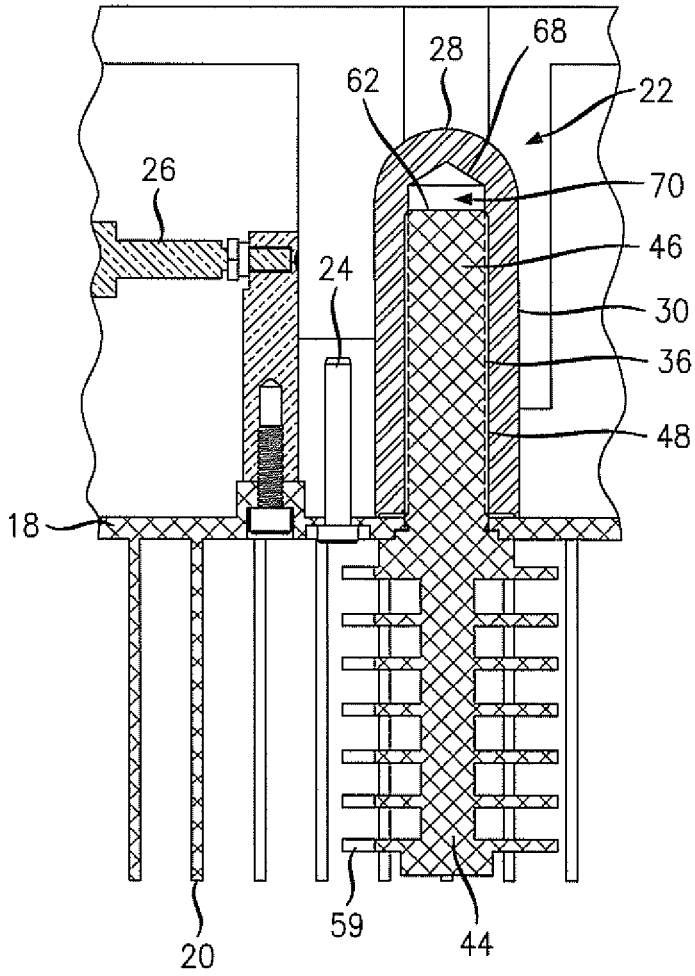
FIG. 7 is a cross-sectional view from line 7-7 of FIG. 2, illustrating a resonator and rod according to an exemplary embodiment.

FIG. 7 illustrates a cross-sectional view from line 7-7 of FIG. 2. The mounting portion 46 of the rod 42 extends through the floor 18 to the interior of the resonator 22. The exterior threads 50 on the exterior mounting surface 48 of the mounting portion 46 engage the interior threads 38 on the central interior surface 36 of the resonator 22. In the present embodiment, an upper interior surface 68 of the resonator 22 is conical. The upper interior surface 68 may be formed into other shapes including, but not limited to, domed and flat. The upper interior surface 68 is positioned within the resonator to provide a headspace 70 above the top surface 62 of the rod 42.

Figure 8:
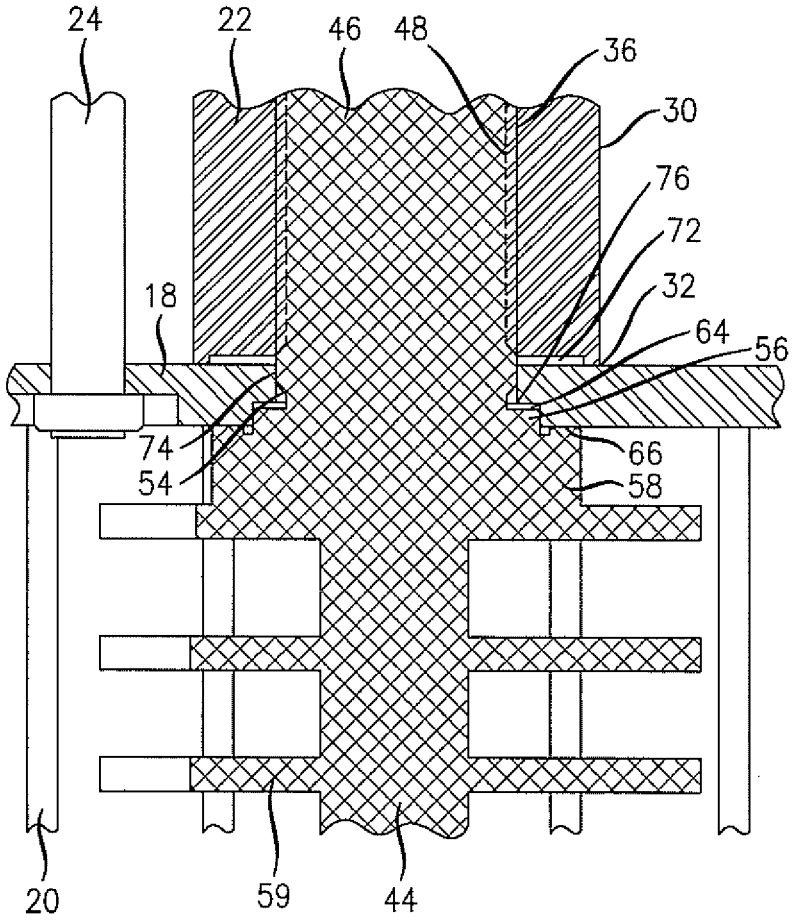
FIG. 8 is a magnified cross-sectional view of the resonator and rod of FIG. 7.

A magnified view of the floor 18, mounting portion 46, and thermal dissipation portion 44 is shown in FIG. 8. The lip 32 is adjacent the top side of the floor 18. A resonator gap 72 exists between the bottom surface 34 of the resonator 22 and the top side of the floor 18. The clamping surface 66 of the clamping ring 58 is adjacent the bottom side of the floor 18. The sealing ring 56 extends into a notch 74 in the bottom side of the floor 18. A seal gap 76 exists between the upper seal surface 64 and the upper surface of the notch 74. The lower tapered surface 54 of the mounting portion 46 is positioned at the level of the floor 18.

The resonator 22 is secured against the floor 18 by engaging the interior threads 38 of the resonator 22 with the exterior threads 50 of the mounting portion 46 of the rod 42. The rod 42 is tightened by turning the tool-engageable feature 60 of the thermal dissipation portion 44. The rod 42 is tightened until the lip 32 of the resonator 22 presses against the upper side of the floor 18 and the clamping surface 66 of the clamping ring 58 presses against the lower side of the floor 18. The bottom surface of the lip 32 has a smaller surface area than the bottom surface 34 of the resonator 22. The smaller surface area of the lip 32 allows for a stronger contact with the floor 18, as compared to the bottom 112 contacting the floor 18 without a lip. A strong contact between the resonator 22 and the floor 18 may help reduce intermodulation problems, among other benefits.

The exterior mounting surface 48 of the mounting portion 46 contacts the central interior surface 36 of the resonator 22. The contact allows for heat from the resonator 22 to be transferred to the rod 42. Thermal grease may be used to aid the contact between the two surfaces 246,240. The headspace 70 above the top surface 62 of the rod 42 allows the rod 42 to expand as its temperature increases. The amount of heat that may be transferred from the resonator 22 to the rod 42 may be increased by increasing the contact area between the exterior mounting surface 48 and the central interior surface 36. The mounting portion 46 preferably extends the majority of the way into the resonator 22, while leaving sufficient headspace 70 to allow for the thermal expansion of the rod 42.

The heat transferred from the resonator 22 to the mounting portion 46 of the rod 42 is dissipated through the thermal dissipation portion 44 of the rod 42. The thermal dissipation portion 44 may utilize various thermal dissipation configurations including, but not limited to, for example, heatsinks, heatpipes, liquid cooling, and/or thermoelectric cooling. The rod 42 moves heat to the outside of the cavity 12, where it is more easily dissipated. In an exemplary embodiment, the rod 42 dissipates heat via circular disks 59. The circular disks 59 provide a large surface area from which heat can be radiated. A fan (not shown) may move air across the circular disks 59 to aid in the heat radiation.

The resonator 22 is preferably made of 64FeNi, but other materials may be used. 64FeNi is preferable due to its low coefficient of thermal expansion (CTE). A low CTE further helps to minimize changes in the cavity geometry. In an exemplary embodiment, the housing 14 is made from aluminum. The rod 42 is preferably made from aluminum, but any thermally conductive material may be used, such as for example, copper, gold, and silver.

The geometry of the cavity filter 10 is influenced by the tuning post 24 and the resonator 22. The tuning post 24 is used to precisely adjust the geometry of the cavity 12 to meet a desired resonant frequency and Q factor. Due to the energy of the signals within the cavity filter 10, heat is concentrated near the resonator 22. In particular, the heat is focused on the lower portion of the resonator 22, where the resonator 22 meets the floor 18. The heat causes the materials forming the cavity filter 10 to expand, thus changing the geometry of the cavity 12. As the geometry changes, the resonant frequency of the cavity 12 may change and the Q factor of the cavity filter 10 may be lowered (de-Q). The tuning post 24 may need adjustment to compensate for the change in geometry of the cavity 12.

Various embodiments of the present invention dissipate the heat from the resonator 22. Dissipating heat from the resonator 22 helps to stabilize the geometry of the cavity 12. Dissipating heat from the resonator 22 further helps to stabilize the resonant frequency and Q factor of the cavity filter 10.

Although the various exemplary embodiments have been described in detail with particular reference to certain exemplary aspects thereof, it should be understood that the invention is capable of other embodiments and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only and do not in any way limit the invention, which is defined only by the claims.

What is claimed is:

1. A cavity filter having a cavity formed by a floor, at least one wall, and a top, comprising:

a resonator within the cavity having an interior surface and an exterior surface; and a rod having a mounting portion and a thermal dissipation portion comprising a plurality of disks radially extending from a central shaft, wherein the central shaft extends axially from the mounting portion, the mounting portion of the rod extends through the floor of the cavity to engage the interior surface of the resonator, and the thermal dissipation portion of the rod extends outside the cavity.

2. The cavity filter of claim 1, wherein the rod further comprises:

a clamping surface between the mounting portion and the thermal dissipation portion, the clamping surface engaging a side of the floor outside the cavity.

3. The cavity filter of claim 1, wherein the resonator further comprises:

a lip extending from a lower surface of the resonator, the lip engaging a side of the floor inside the cavity.

4. The cavity filter of claim 1, wherein the mounting portion further comprises:

an exterior surface having first threads; and wherein the interior surface of the resonator further comprises:

second threads.

5. The cavity filter of claim 1, wherein the resonator is secured against the floor of the cavity by a force exerted by the rod.

6. The cavity filter of claim 1, wherein the resonator is made of a 64FeNi alloy.

7. The cavity filter of claim 1, wherein the rod is made of at least one of aluminum, copper, gold, and silver.

8. An apparatus for mounting a resonator within a cavity filter having a cavity formed by a floor, at least one wall, and a top, the apparatus comprising:

a thermal dissipation portion comprising a plurality of disks radially extending from a central shaft; and a mounting portion extending through the floor of the cavity; wherein the mounting portion engages an interior surface of the resonator, the central shaft extends axially from the mounting portion, and the thermal dissipation portion extends outside the cavity.

9. The apparatus of claim 8, further comprising:

a clamping surface between the mounting portion and the thermal dissipation portion, the clamping surface engaging a side of the floor outside the cavity.

10. The apparatus of claim 9, wherein the resonator further comprises:

a lip extending from a lower surface of the resonator, the lip engaging a side of the floor inside the cavity.

11. The apparatus of claim 8, wherein the mounting portion further comprises:

an exterior surface having first threads; and wherein the interior surface of the resonator further comprises:

second threads.

12. The apparatus of claim 10, wherein the resonator is secured against the floor of the cavity by a force exerted by the clamping surface and a force exerted by the lip.

13. The apparatus of claim 8, wherein the apparatus is made of at least one of aluminum, copper, gold, and silver.

14. A method for dissipating heat from a resonator within a cavity filter, the cavity filter having a cavity formed by a floor, at least one wall, and a top, the method comprising:

extending a mounting portion of a rod through the floor of the cavity filter;

engaging an interior surface of the resonator with the mounting portion; and dissipating heat through a thermal dissipation portion of the rod outside the cavity, wherein the thermal dissipation portion comprises a plurality of disks radially extending from a central shaft and the central shaft extends axially from the mounting portion.

15. The method according to claim 14, wherein the rod further comprises a clamping surface between the mounting portion and the thermal dissipation portion, the clamping surface engaging a side of the floor outside the cavity.

16. The method according to claim 14, wherein the resonator further comprises a lip extending from a lower surface of the resonator, the lip engaging a side of the floor inside the cavity.

17. The method according to claim 14, wherein the mounting portion further comprises an exterior surface having first threads, and the interior surface of the resonator further comprises second threads.

18. The method according to claim 14, further comprising:

securing the resonator against the floor of the cavity by a force exerted by the rod.

* * * * *